US007794058B2

(12) United States Patent
Seida et al.

(10) Patent No.: US 7,794,058 B2
(45) Date of Patent: Sep. 14, 2010

(54) LIQUID DISCHARGE HEAD AND METHOD FOR MANUFACTURING THE SAME

(75) Inventors: Hiroshi Seida, Kawasaki (JP); Riichi Saito, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 700 days.

(21) Appl. No.: 11/751,296

(22) Filed: May 21, 2007

(65) Prior Publication Data

US 2007/0285477 A1 Dec. 13, 2007

(30) Foreign Application Priority Data

May 29, 2006 (JP) ..... 2006-148146

(51) Int. Cl.
*B41J 2/05* (2006.01)

(52) U.S. Cl. ..... 347/62

(58) Field of Classification Search ..... 347/62, 347/54, 56–59, 61, 63, 65, 50, 44, 20, 9, 347/5

See application file for complete search history.

(56) References Cited

U.S. PATENT DOCUMENTS

| | | | | |
|---|---|---|---|---|
| 6,123,410 | A | 9/2000 | Beerling et al. | |
| 6,174,050 | B1 * | 1/2001 | Kashino et al. | 347/65 |
| 6,241,340 | B1 | 6/2001 | Watanabe et al. | |
| 6,322,206 | B1 | 11/2001 | Boyd et al. | |
| 6,325,488 | B1 | 12/2001 | Beerling et al. | |
| 6,341,845 | B1 | 1/2002 | Scheffelin et al. | |
| 6,428,145 | B1 | 8/2002 | Feinn et al. | |
| 6,450,614 | B1 | 9/2002 | Scheffelin et al. | |
| 6,454,955 | B1 | 9/2002 | Beerling et al. | |
| 6,464,333 | B1 | 10/2002 | Scheffelin et al. | |
| 6,471,901 | B1 | 10/2002 | Kawamura et al. | |
| 6,536,868 | B1 | 3/2003 | Kawamura et al. | |
| 6,592,205 | B2 | 7/2003 | Beerling et al. | |
| 6,629,755 | B2 | 10/2003 | Saito et al. | |
| 6,705,705 | B2 | 3/2004 | Horvath et al. | |
| 6,733,112 | B2 | 5/2004 | Scheffelin et al. | |
| 6,789,878 | B2 | 9/2004 | Scheffelin et al. | |
| 2001/0033312 | A1 * | 10/2001 | Isshiki | 347/54 |
| 2007/0242101 | A1 | 10/2007 | Hirosawa et al. | |
| 2007/0242102 | A1 | 10/2007 | Hirosawa et al. | |

FOREIGN PATENT DOCUMENTS

| | | |
|---|---|---|
| JP | 11-192705 | 7/1999 |

* cited by examiner

*Primary Examiner*—K. Feggins
(74) *Attorney, Agent, or Firm*—Fitzpatrick, Cella, Harper & Scinto

(57) ABSTRACT

In order to hermetically seal more surely a gap between a back surface of a liquid discharge substrate and a front surface of a support member, and an electrode portion etc., without adversely affecting discharge performance, a liquid discharge head includes a first sealing resin coated on a portion between the liquid supply port and the pad on the support surface so as to surround a tip end portion at the liquid supply port of the support member and a second sealing resin for sealing a gap between the support member and the liquid discharge substrate, and a peripheral part of the liquid supply port.

10 Claims, 16 Drawing Sheets

LIQUID DISCHARGE HEAD AND METHOD FOR MANUFACTURING THE SAME

BACKGROUND OF THE INVENTION

1. Field of the Invention

The present invention relates to a liquid discharge head for discharging liquid and a method for manufacturing the same.

2. Description of the Related Art

Recently, an ink jet head comes into existence as a liquid discharge head in widespread use. In these years, an ink jet recording apparatus having this ink jet head mounted thereon has largely decreased in price, and therefore a challenge arises how to manufacture the ink jet head in a low cost. For that purpose, miniaturization of a liquid discharge substrate especially has a useful role. For example, because the miniaturization of the liquid discharge substrate allows more liquid discharge substrates to be cut out from a silicon wafer, costs of the ink jet head, i.e., the liquid discharge head, can be reduced.

However, the more the liquid discharge substrate is miniaturized, the smaller a size or pitch of a joint portion of an electrode lead terminal for supplying power and a drive signal becomes, so that it is more difficult to ensure joint reliability. Therefore, it becomes difficult to form, on a surface of a head substrate, an electrical connecting portion to which the electrode lead terminal for supplying power and a drive signal is connected, in a manner that the electrical connecting portion is formed on a conventional head substrate.

Japanese Patent Application Laid-Open No. H11-192705 discloses, as a conventional example for solving the problem of electrical connectivity concerning the ink jet head, a print head having an electrical connection electrode on a surface of a silicon substrate opposing to a surface on which a discharge port is disposed.

FIG. 9 is a partial cross-section view illustrating an electrical connection configuration of the print head disclosed in Japanese Patent Application Laid-Open No. H11-192705 and including the print head and a support substrate.

Referring to FIG. 9, a plurality of print heads 218 is mounted on a support substrate 220.

Each of the plurality of print heads 218 has an electrode 284 for electrical connection and an ink supply port 242 formed on a back surface thereof opposing to a surface on which a nozzle opening 238 is formed. A support substrate 220 for holding the print head 218 has electrical wiring applied on a first surface 270 and a second surface 272. Then, on the first surface 270, the print head 218 is electrically connected using a solder bump and mounted. Further, a logic circuit (not shown) and a drive circuit 230 are mounted on the second surface 272 of the support substrate 220 opposing to the first surface.

However, the ink jet head disclosed in Japanese Patent Application Laid-Open No. H11-192705 has the following problems.

There is a problem relating to sealing of an electrical connecting portion (reliability of quality). The ink jet head is mounted and operated on the ink jet recording apparatus, and used in a state at all times exposed to the environment of ink. Japanese Patent Application Laid-Open No. H11-192705 especially does not describe, in detail, sealing at a joint portion between the electrode on the back surface of the print head and the electrical wiring on a front surface of the support substrate. Therefore, measures are not known against troubles caused by absolutely unanticipated phenomena, such as electrical troubles always due to ink (for example, short circuit and open circuit), and chemical troubles (for example, corrosion or elution of an element (material) used, and change in characteristics of ink components).

Further, a semiconductor element or the like, generally, is completely enclosed with resin such as epoxy to be packaged and completely hermetically sealed without a pin hole, a gap and the like, from the viewpoint of reliability. Similarly to this, the liquid discharge head also is processed, and, needless to say concerning the electrode described above, also a gap between a substrate having a semiconductor element mounted thereon, such as a liquid discharge substrate, and a support member for supporting this substrate has to be completely hermetically sealed.

Further, in the case of sealing at the liquid discharge head, in order to secure liquid discharge performance and landing accuracy in an impact area where discharged liquid impacts a medium, it is necessary to prevent sealing resin from impairing normal functions of the discharge port and a liquid supply port. Therefore, there is restriction specific to the liquid discharge head and severer than that required for a usual semiconductor element, relating to the sealing.

SUMMARY OF THE INVENTION

An object of the present invention is to provide a liquid discharge head and a method for manufacturing the same which can hermetically seal more surely a gap between a back surface of a liquid discharge substrate and a front surface of a support member, and an electrode portion, etc., without adversely affecting discharge performance.

A further object of the present invention is to provide a method for manufacturing a liquid discharge head including: on a front surface thereof, a plurality of discharge ports for discharging liquid and an energy generating unit for generating energy for discharging liquid; on a back surface thereof, a plurality of electrodes; and a support member including a liquid discharge substrate having a through-hole for feeding liquid from a back surface to a front surface, a support surface for supporting the liquid discharge substrate thereon, a pad disposed on the support surface and connected to the plurality of electrodes, and a rectangular liquid supply port for supplying liquid to the through-hole of the liquid discharge substrate, wherein the method includes: coating first sealing resin on a portion between the liquid supply port and the pad on the support surface so as to surround a tip end portion at the liquid supply port of the support member when a mounting portion of the liquid discharge substrate and the support member is hermetically sealed; mounting the liquid discharge substrate on the support member to join one of the plurality of electrodes to the pad; and filling a gap between the support member and the liquid discharge substrate with a second sealing resin from the circumference of the liquid discharge substrate on the support member.

Another object of the present invention is to provide a liquid discharge head including: on a front surface thereof, a plurality of discharge ports for discharging liquid and an energy generating unit for generating energy for discharging liquid; on a back surface thereof, a plurality of electrodes; and a support member including a liquid discharge substrate having a through-hole for feeding liquid from a back surface to a front surface, a support surface for supporting the liquid discharge substrate thereon, a pad disposed on the support surface and connected to the plurality of electrodes, and a rectangular liquid supply port for supplying liquid to the through-hole of the liquid discharge substrate, and for joining one of the plurality of electrodes to the pad to mount the liquid discharge substrate on the support member, wherein the liquid discharge head includes: a first sealing resin coated on a portion between the liquid supply port and the pad of the support surface so as to surround a tip end portion at the liquid supply port of the support member; and a second sealing resin for hermetically sealing a gap between the support member and the liquid discharge substrate, and a peripheral part of the liquid supply port.

Further features of the present invention will become apparent from the following description of exemplary embodiments with reference to the attached drawings.

DESCRIPTION OF THE EMBODIMENTS

Now, an embodiment of the present invention will be described hereinafter with reference to the accompanying drawings.

Figure 1:
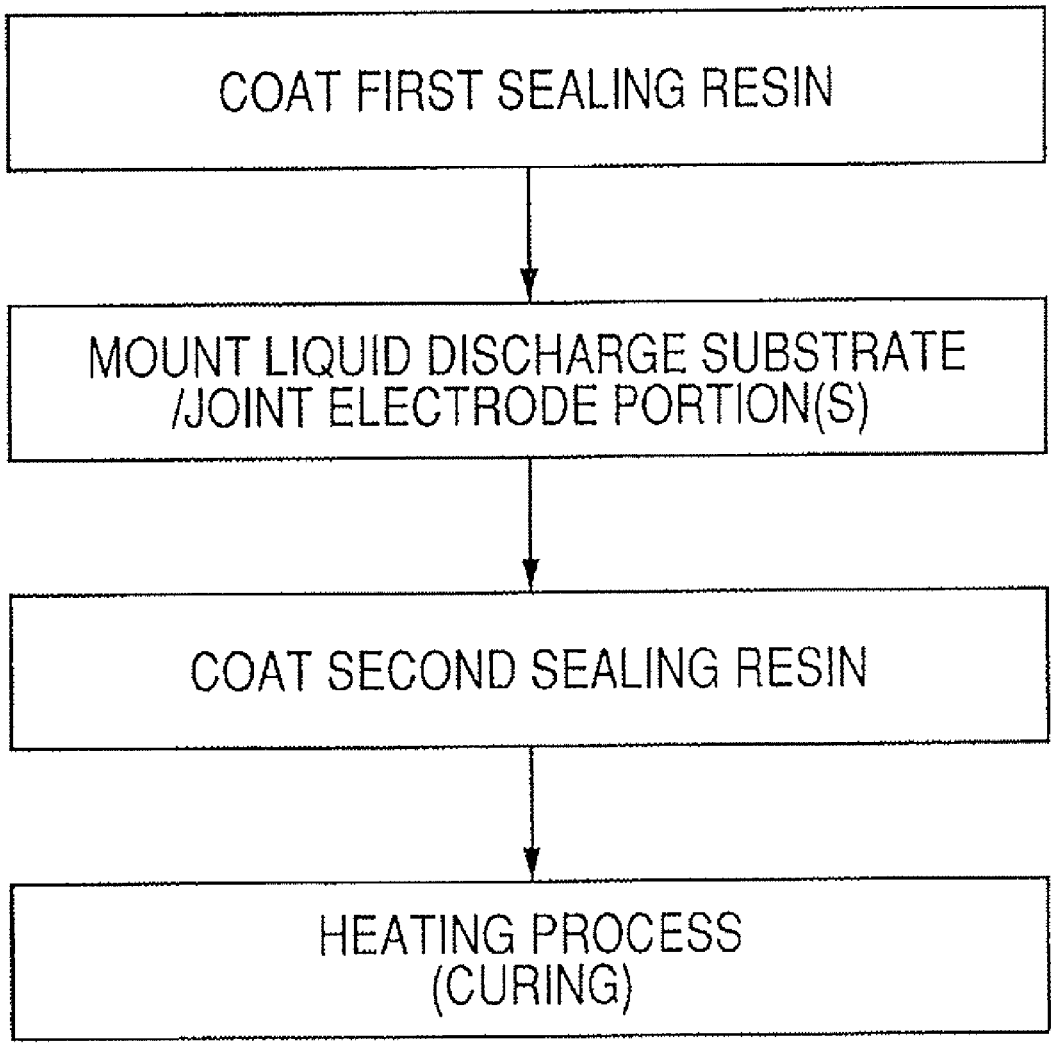
FIG. 1 is a flow diagram illustrating main processes of a manufacturing method for an ink jet head in an embodiment of the present invention.

FIG. 1 is a flow diagram illustrating main processes for manufacturing an ink jet head in an embodiment of a liquid discharge head of the present invention. A manufacturing method for the ink jet head including these processes will be described hereinafter in detail with reference to FIGS. 2A to 6B.

Figure 2A:
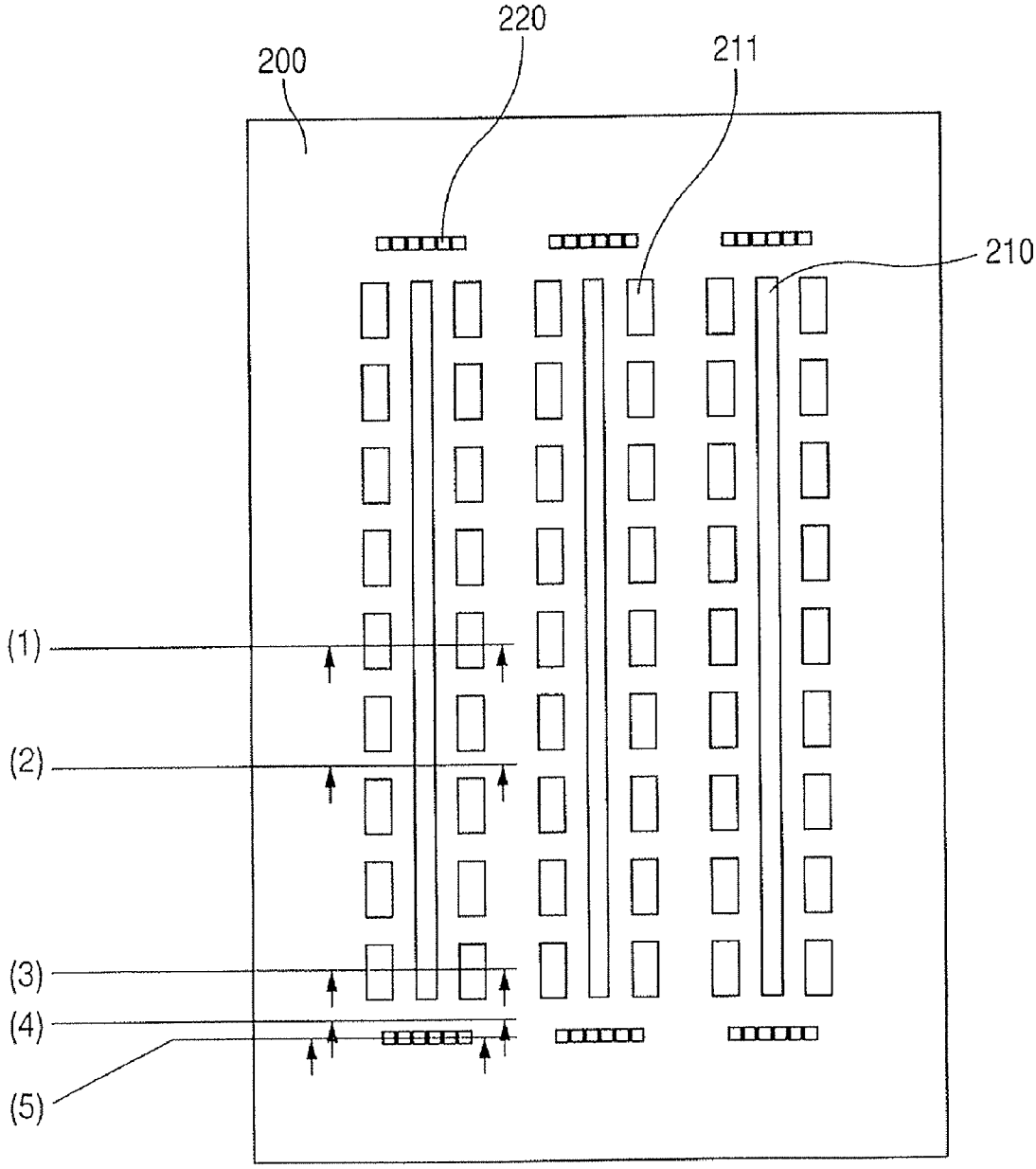
FIG. 2A is a plan view diagrammatically illustrating a support member for supporting a recording element substrate as a liquid discharge substrate, when an ink jet head as a liquid discharge head is seen from above in FIG. 7.
Figure 2B:
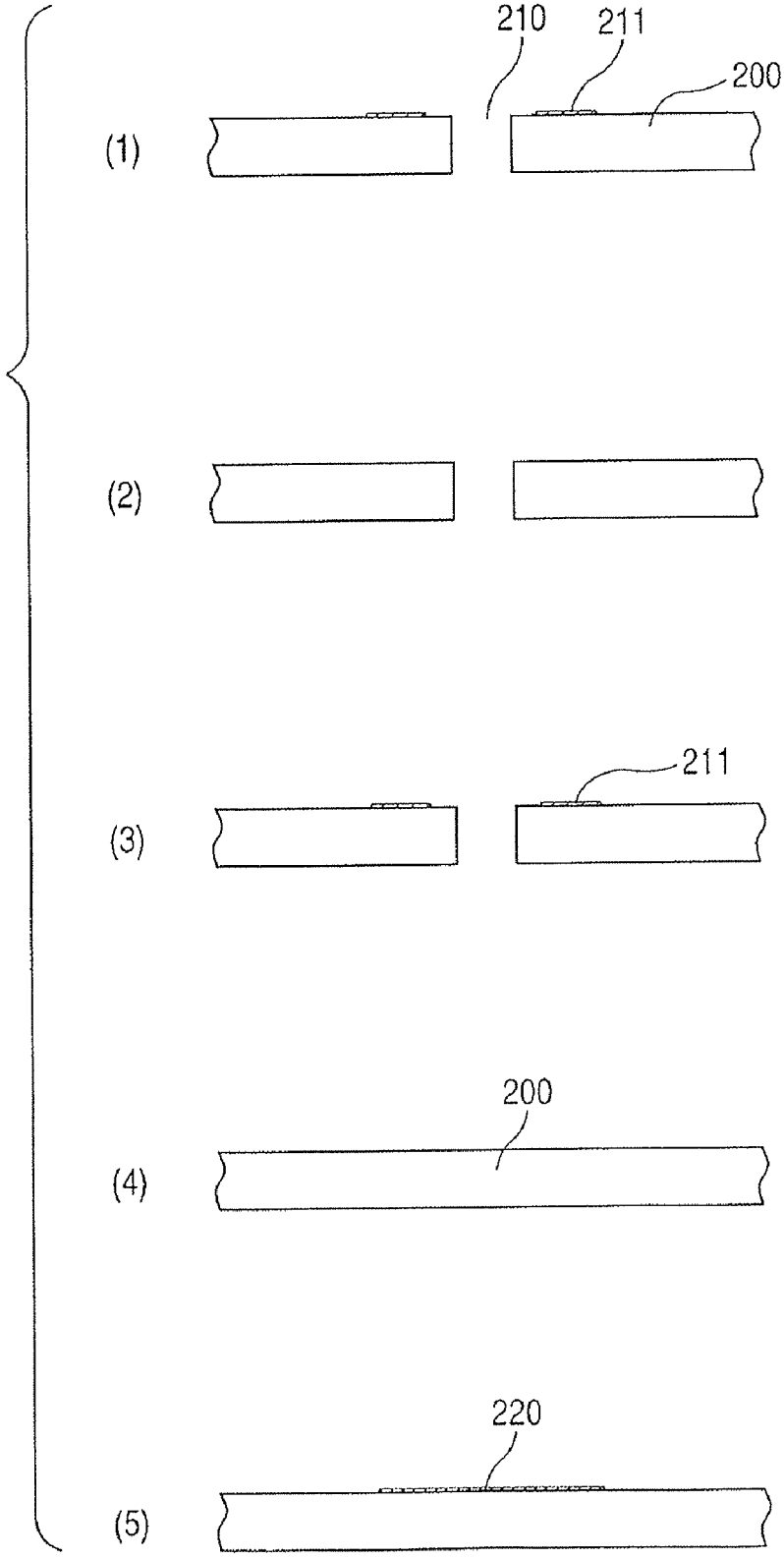
FIG. 2B is a diagrammatical cross-section view taken along lines (1) to (5) shown in FIG. 2A.
Figure 7:
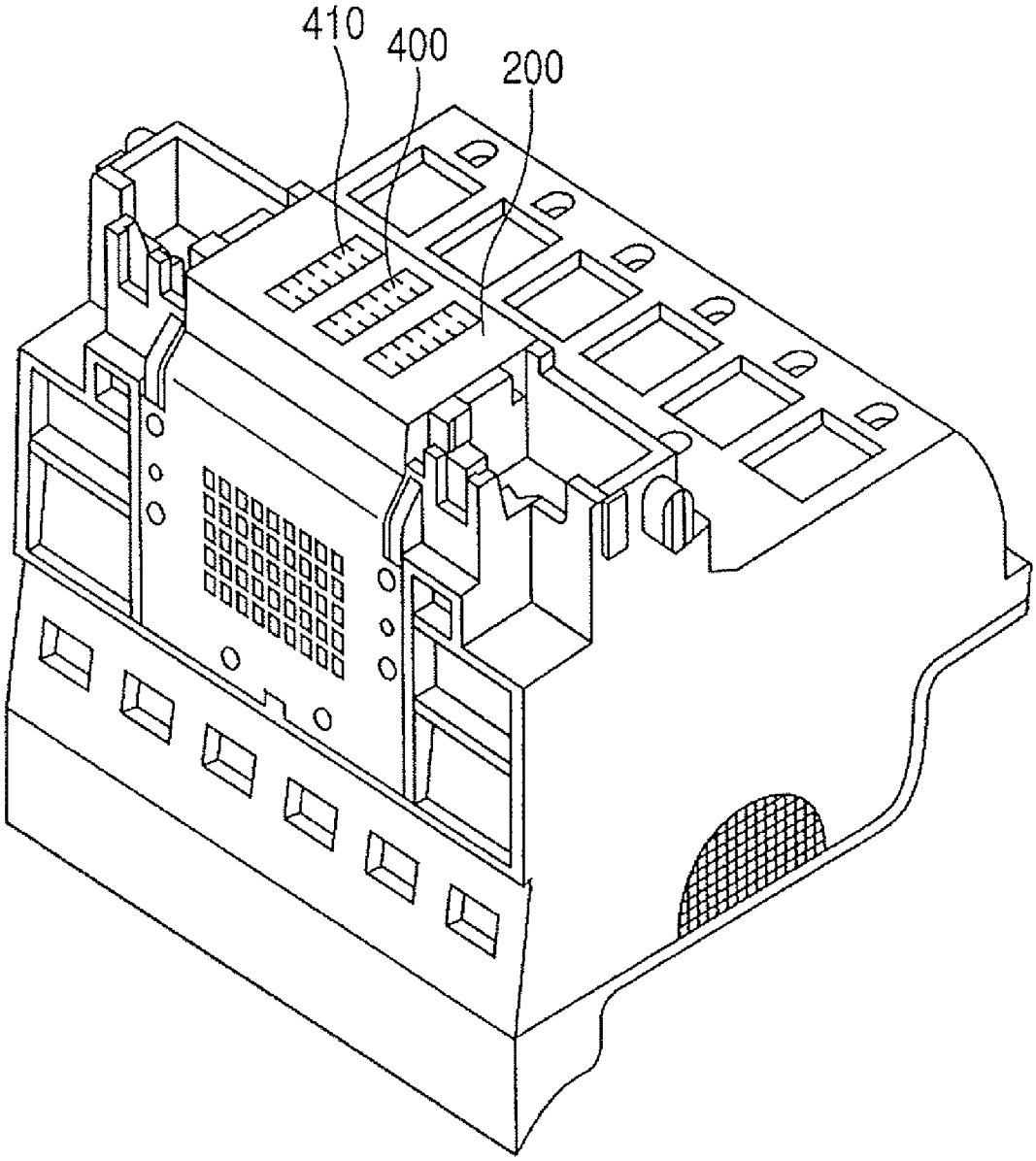
FIG. 7 is an overall perspective view illustrating a head cartridge on which the ink jet head of the present embodiment of the present invention is mounted.

FIG. 2A is a schematic plan view of a surface of a support member 200 for supporting a recording element substrate 400, which supports the recording element substrate 400 of the ink jet head cartridge as shown in FIG. 7. Further, FIG. 2B is a diagrammatical cross-section view taken along lines (1) to (5) shown in FIG. 2A. Referring to both drawings, a structure of the support member 200 will be described, which is one of members hermetically sealed in manufacturing processes according to the present embodiment.

The support member 200 has an ink supply port 210 formed thereon as one of a plurality of liquid supply ports passing through the support member 200. Each ink supply port 210 is formed in a long rectangle in the longitudinal direction of the support member 200. That is, the ink supply port 210 is an elongated, rectangular opening, as seen from an upper surface of the support member 200.

On a front surface of the support member 200 having the recording element substrate 400 as the liquid discharge substrate to be mounted, an electrode pad 220 is disposed on the further outside of both tip end portions of the ink supply port 210. Further, on a back surface of the support member 220, i.e. a surface opposing to the front surface on which the electrode pad 220 is disposed, a backside electrode terminal (not shown) is formed. This backside electrode terminal is electrically connected to the electrode pad 220 on the front surface of the support member 200 through an electrical wiring pattern wired inside the support member 200.

Moreover, on the front surface of the support member 200, a plurality of radiation pads 211 is disposed along and near a long side of the ink supply port 210.

Figure 3A:
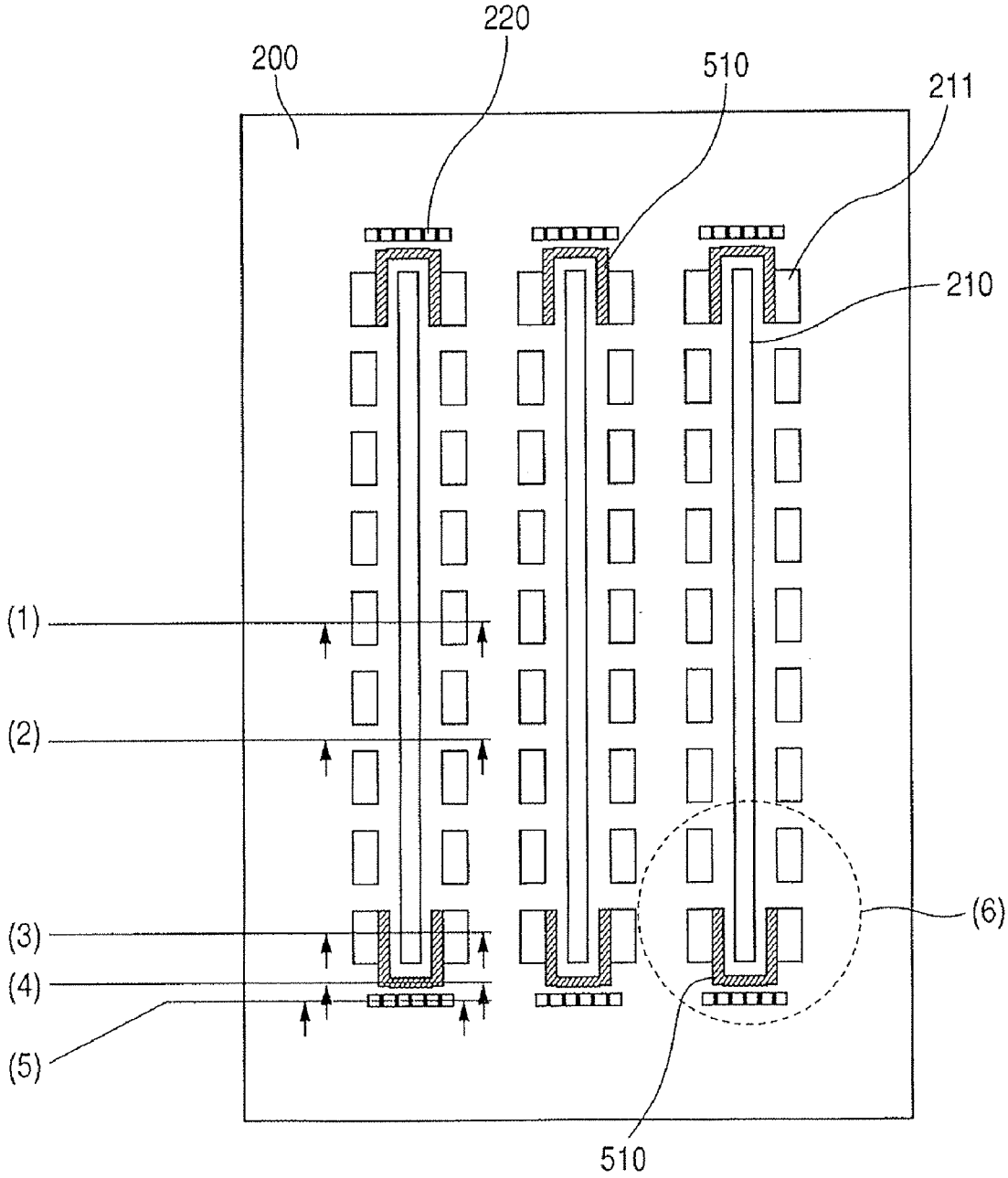
FIG. 3A is a view illustrating a situation in which first sealing resin is coated on the support member in FIG. 2A.
Figure 3B:
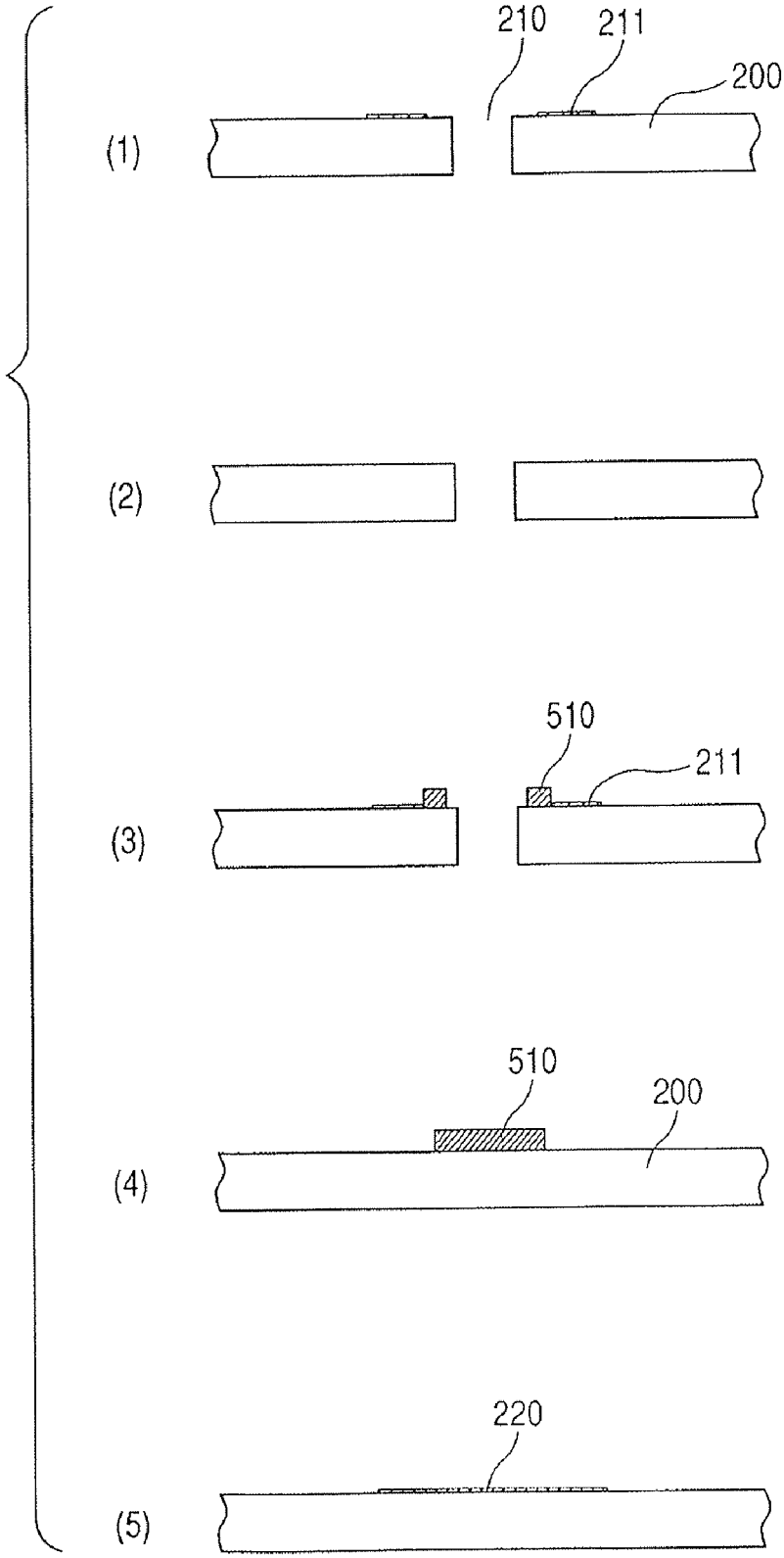
FIG. 3B is a diagrammatical cross-section view taken along lines (1) to (5) shown in FIG. 3A.
Figure 3C:
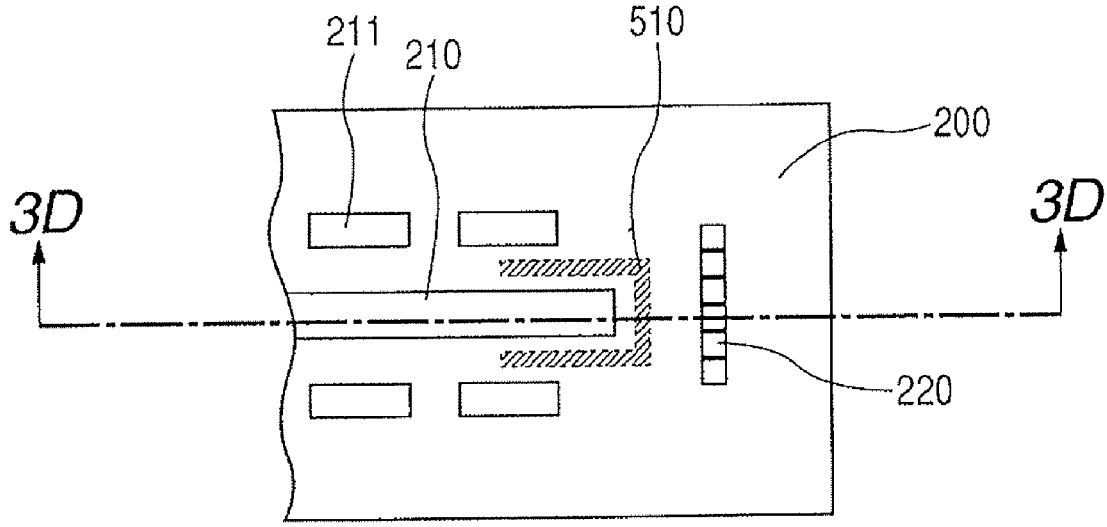
FIG. 3C is an enlarged view illustrating a part in a circle (6) shown in FIG. 3A.
Figure 3D:
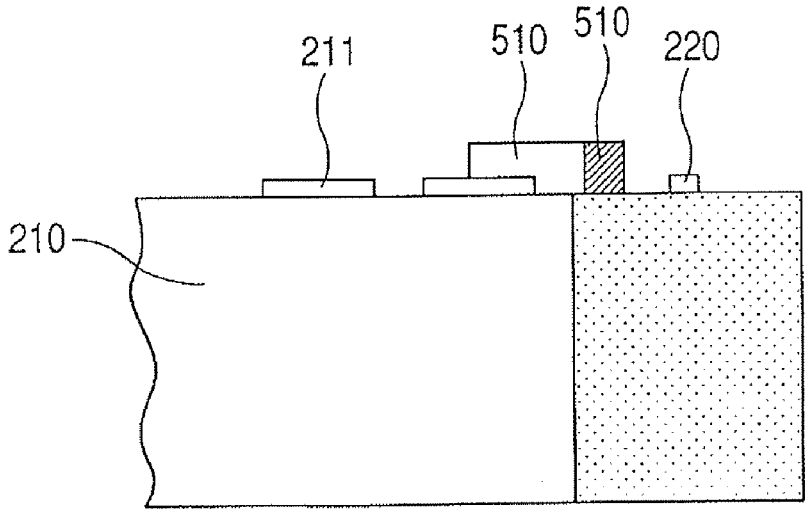
FIG. 3D is a cross-section view taken along a line 3D-3D in FIG. 3C.

FIG. 3A illustrates a situation in which the first sealing resin 510 is coated on the support member 200 in FIG. 2A. FIG. 3B is a diagrammatical cross-section view taken along lines (1) to (5) shown in FIG. 3A. Further, FIG. 3C is an enlarged view illustrating a part in a circle (6) shown in FIG. 3A. Also, FIG. 3D is a cross-section view taken along a line 3D-3D in FIG. 3C.

On the front surface of the support member 200, the first sealing resin 510 is coated on a portion between each of the both tip end portions of the ink supply port 210 and the electrode pad 220 situated on the outside of each tip end portion, and a portion between the radiation pad 211 and the ink supply port 210. Moreover, the first sealing resin 510 is coated in "U-shape" so as to surround each of the both tip end portions of the ink supply port 210 (see FIG. 3C). This shape has one side in the direction intersecting with the longitudinal direction of the ink supply port 210, and two sides in the longitudinal direction thereof, presenting a projecting shape which surrounds each tip end portion of the ink supply port 210.

Then, here, because it is desirable to maintain a coated shape without change as far as possible, it is preferable to use resin having characteristics of high viscosity/high thixotropy. In the present embodiment, the resin having viscosity which was not smaller than 100 Pa·s and not greater than 200 Pa·s was used. The thixotropic index thereof was not smaller than 1.8 and not greater than 2.2. This imparted the projecting shape in U-shape described above to the first sealing resin 510 on the surface of the support member 200.

Figure 4A:
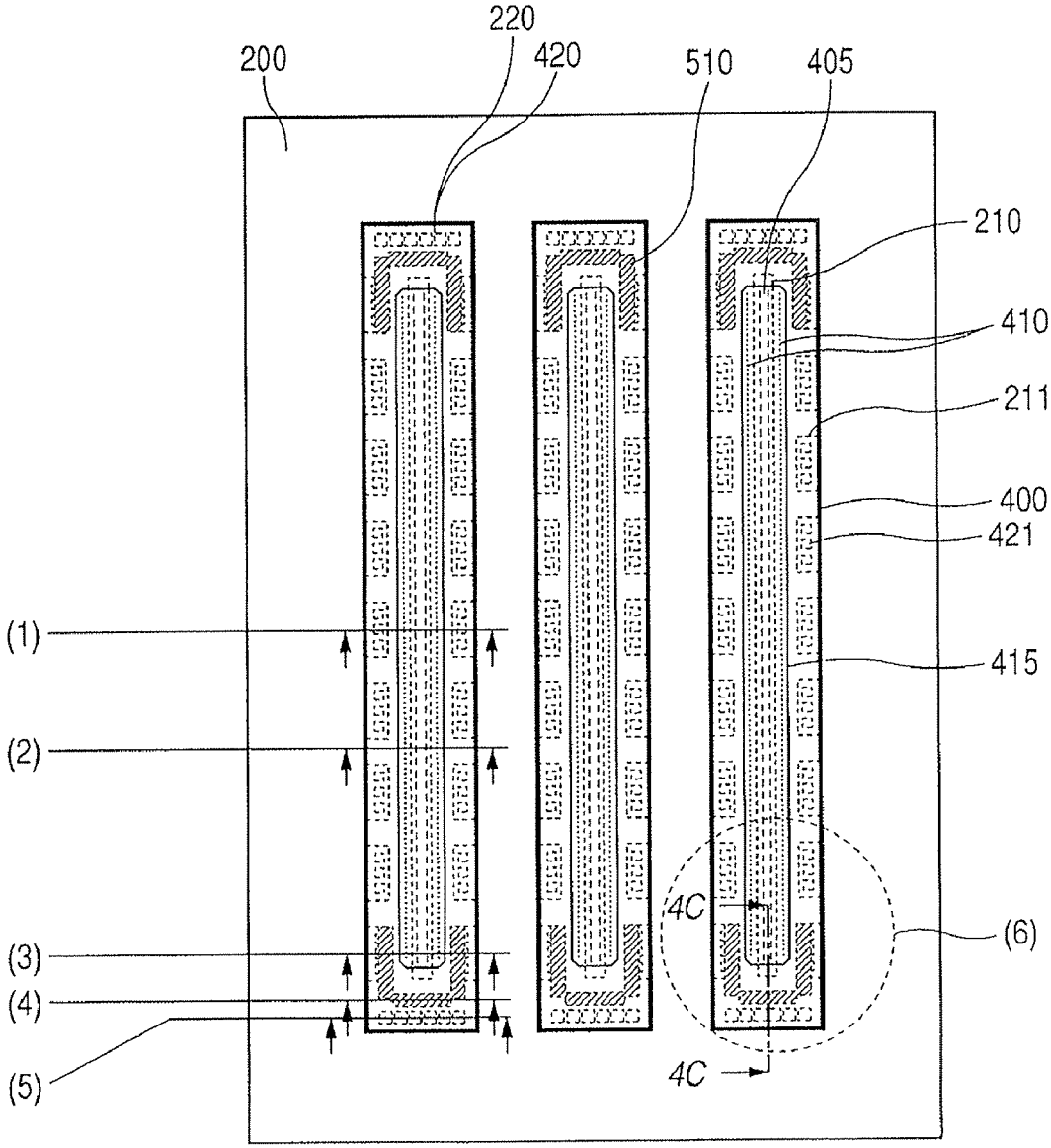
FIG. 4A is a view illustrating a situation in which the recording element substrate is mounted on the support member in FIG. 3A.
Figure 4B:
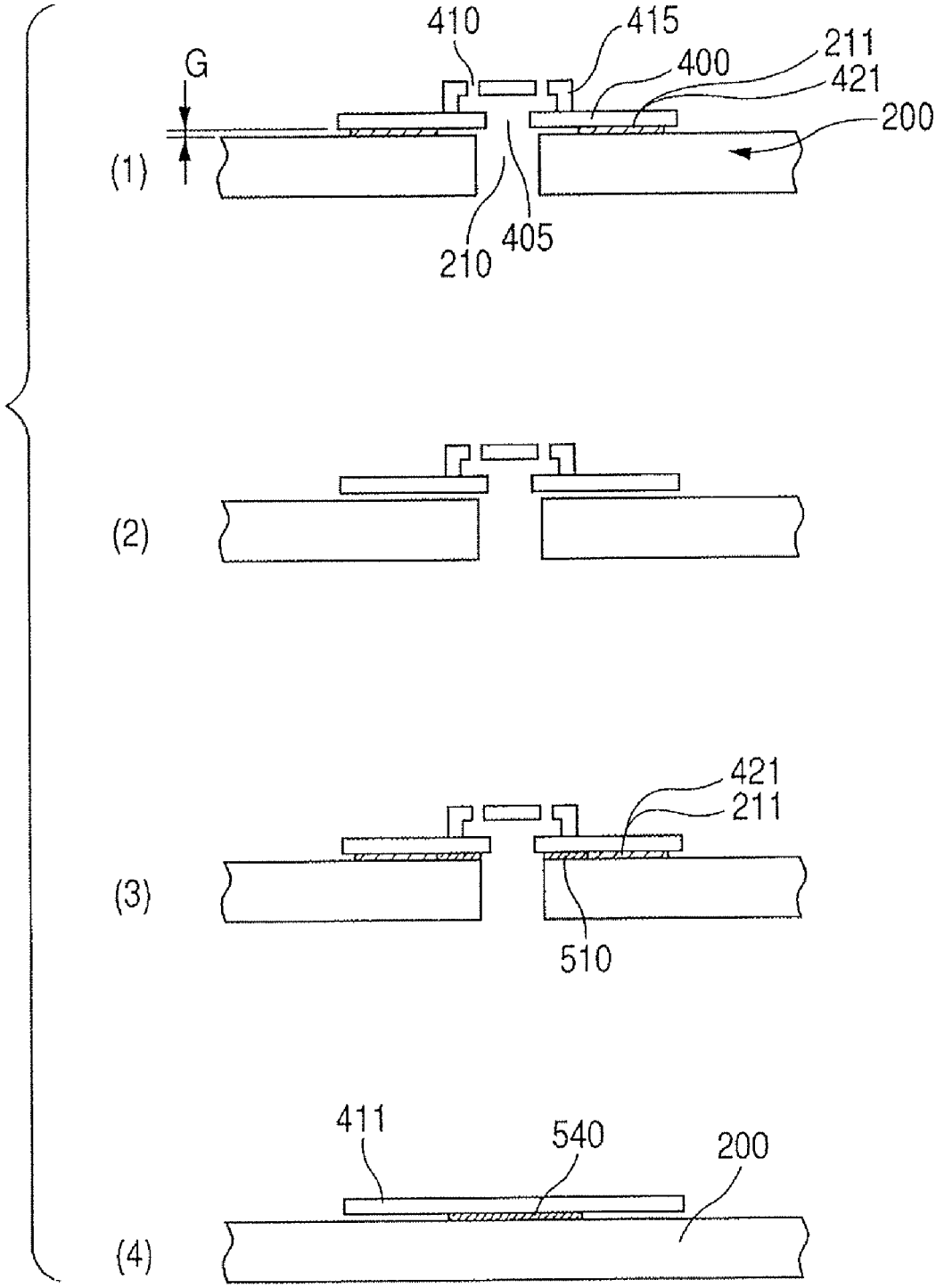
FIG. 4B is a diagrammatical cross-section view taken along lines (1) to (5) shown in FIG. 4A.
Figure 4C:
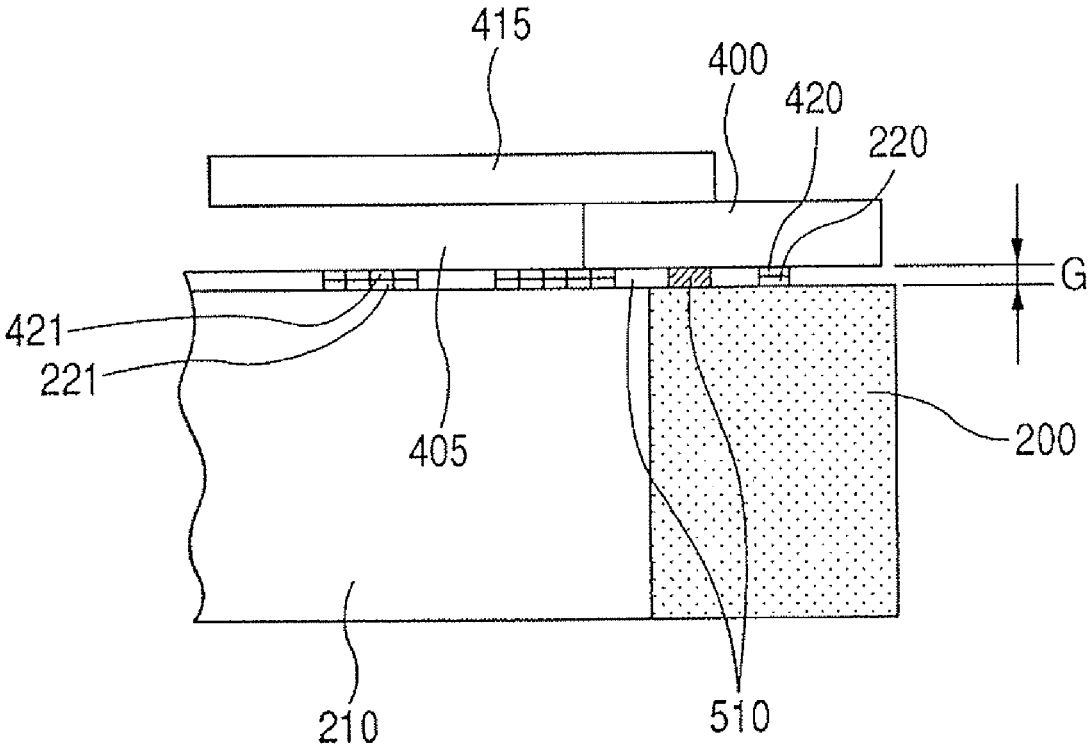
FIG. 4C is an enlarged cross-section view along a line of 4C-4C, illustrating a part in a circle (6) shown in FIG. 4A.

FIG. 4A illustrates a situation in which the recording element substrate 400 is mounted on the support member 200 in FIG. 3A. FIG. 4B is a diagrammatic cross-section view taken along lines (1) to (5) shown in FIG. 4A. Further, FIG. 4C is an enlarged cross-section view along the line of 4C-4C, illustrating a part in a circle (6) shown in FIG. 4A.

On the recording element substrate 400, the ink supply port 405, i.e., a through-hole for supplying liquid from a back surface to a front surface of the substrate is formed. This ink supply port 405 has a shape similar to that of the ink supply port 210 as a liquid supply port of the support member 200 and communicates with the ink supply port 210.

On the front surface of the recording element substrate 400, a plurality of electrothermal conversion elements (not shown), each an energy generating unit for generating energy for discharging ink which is liquid, is disposed side-by-side with the ink supply port 405 between. Further, a channel forming member 415 is joined to the front surface of the recording element substrate 400, which forms a liquid chamber surrounding each of the plurality of electrothermal conversion elements, an ink discharge port 410 communicating with each liquid chamber and serving as a liquid discharge port, and an ink feeding tube (liquid tube) for feeding ink from the ink supply port 405 to each liquid chamber. A plurality of the ink discharge ports 410 is disposed in line in the longitudinal direction of the recording element substrate 400.

Further, on the back surface of the recording element substrate 400, an electrode (bump) 420 to be connected to the electrode pad 220 on the front surface of the support member 200, and a radiation bump 421 to be connected to the radiation pad 211 on the front surface of the support member 200 are provided.

The recording element substrate 400 is mounted on the support member 200 by joining the electrode pad 220 of the support member 200 and the electrode (bump) 420 of the recording element substrate 400 using ultrasonic bonding etc. At this time, the shape of the first sealing resin 510 is crushed due to mounting of the recording element substrate 400 to be slightly reduced in height compared to the projecting shape initially coated to form. However, as described above, the first sealing resin 510 may scarcely spread over a coated area owing to the usage of material having a high thixotropic index (thixotropy). Therefore, the height of the first sealing resin 510 does not become lower than a height of a gap G between the recording element substrate 400 and the support member 200 on the first sealing resin 510. Here, even after the recording element substrate 400 is mounted on the support member 200, the first sealing resin 510 hermetically seals the gap G between the recording element substrate 400 and the support member 200, and still maintains the shape thereof in a manner that communication between the ink supply port 210 and the ink supply port 405 is not blocked. Therefore, the first sealing resin 510 can serve as a bank which prevents the ink from flowing from the ink supply port 210 to reach the electrode pad 220 and the electrode (bump) 420.

In addition, as required, at this time, a heating process (curing) may be carried out to cure the first sealing resin 510, then, the following processes described below may be carried out.

Figure 5A:
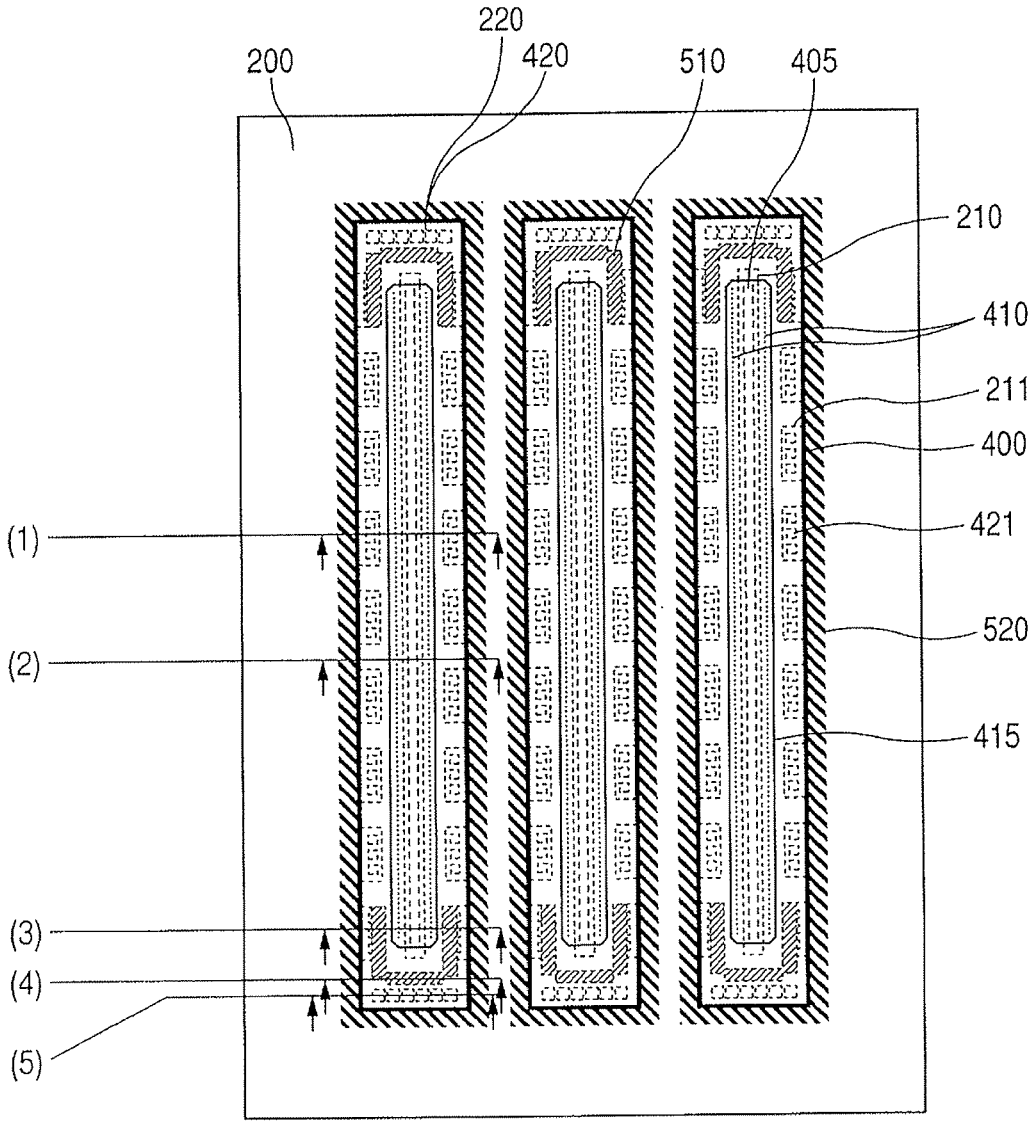
FIG. 5A is a view illustrating a situation in which second sealing resin 520 is coated in the situation shown in FIG. 4A.
Figure 5B:
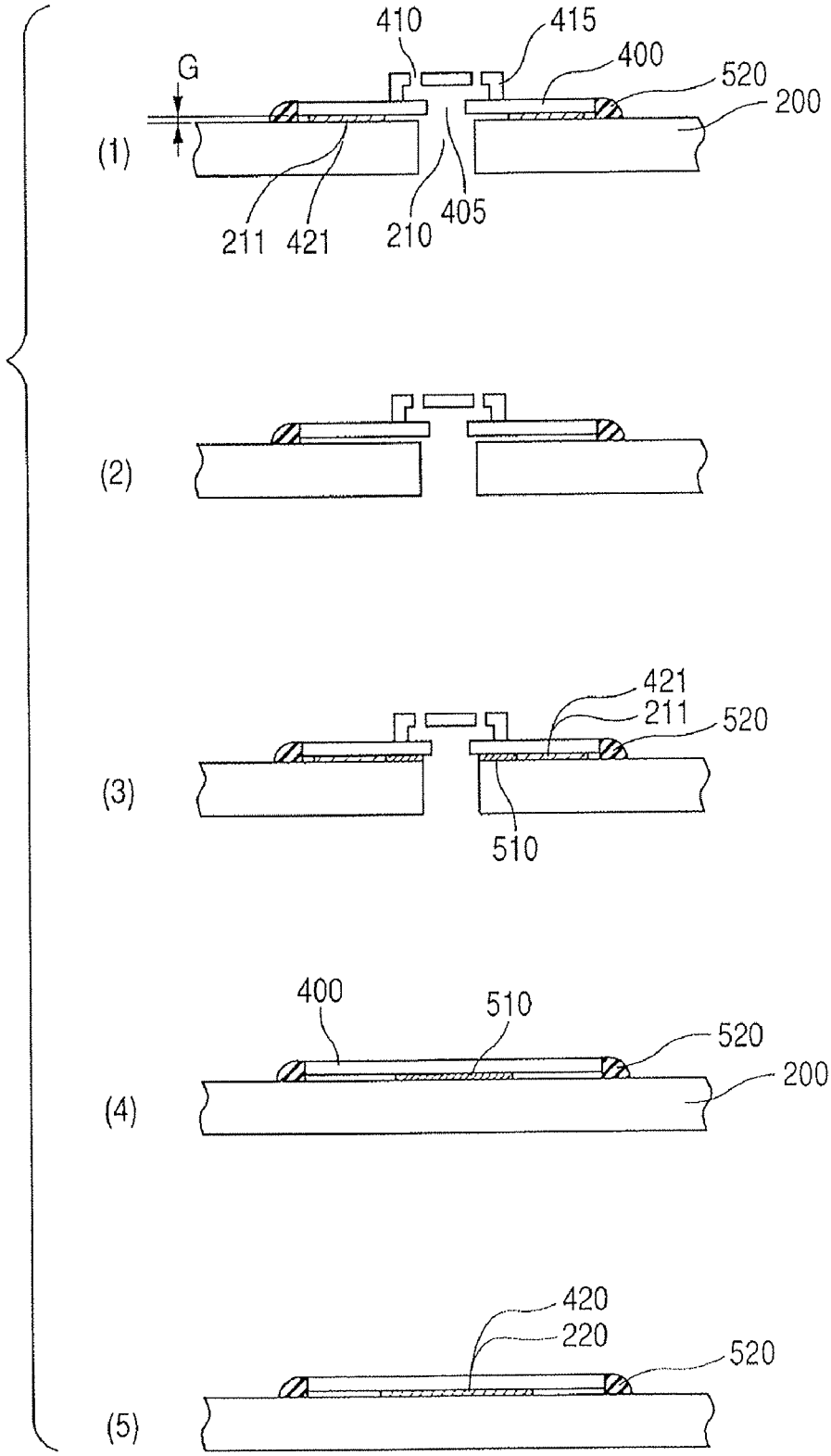
FIG. 5B is a diagrammatical cross-section view taken along lines (1) to (5) shown in FIG. 5A.

FIG. 5A illustrates a situation in which second sealing resin 520 is coated in the situation shown in FIG. 4A. Further, FIG. 5B is a diagrammatical cross-section view taken along lines (1) to (5) shown in FIG. 5A.

The second sealing resin 520 is coated on the entire circumference of a side surface of the recording element substrate 400. At this time, the second sealing resin 520 used is preferably resin which has low viscosity/low thixotropy and good fluidity as much as possible. In the present embodiment, the resin having viscosity which was not smaller than 10 Pa·s and not greater than 70 Pa·s was used. The thixotropic index thereof was not smaller than 0.9 and not greater than 1.1, but it may be smaller than this. Accordingly, the second sealing resin 520 may get through the gap G between the support member 200 and the liquid discharge substrate 400 into the inside thereof due to the capillary phenomenon.

Subsequently, a heating process (curing) is performed to cure the second sealing resin 520.

Figure 6A:
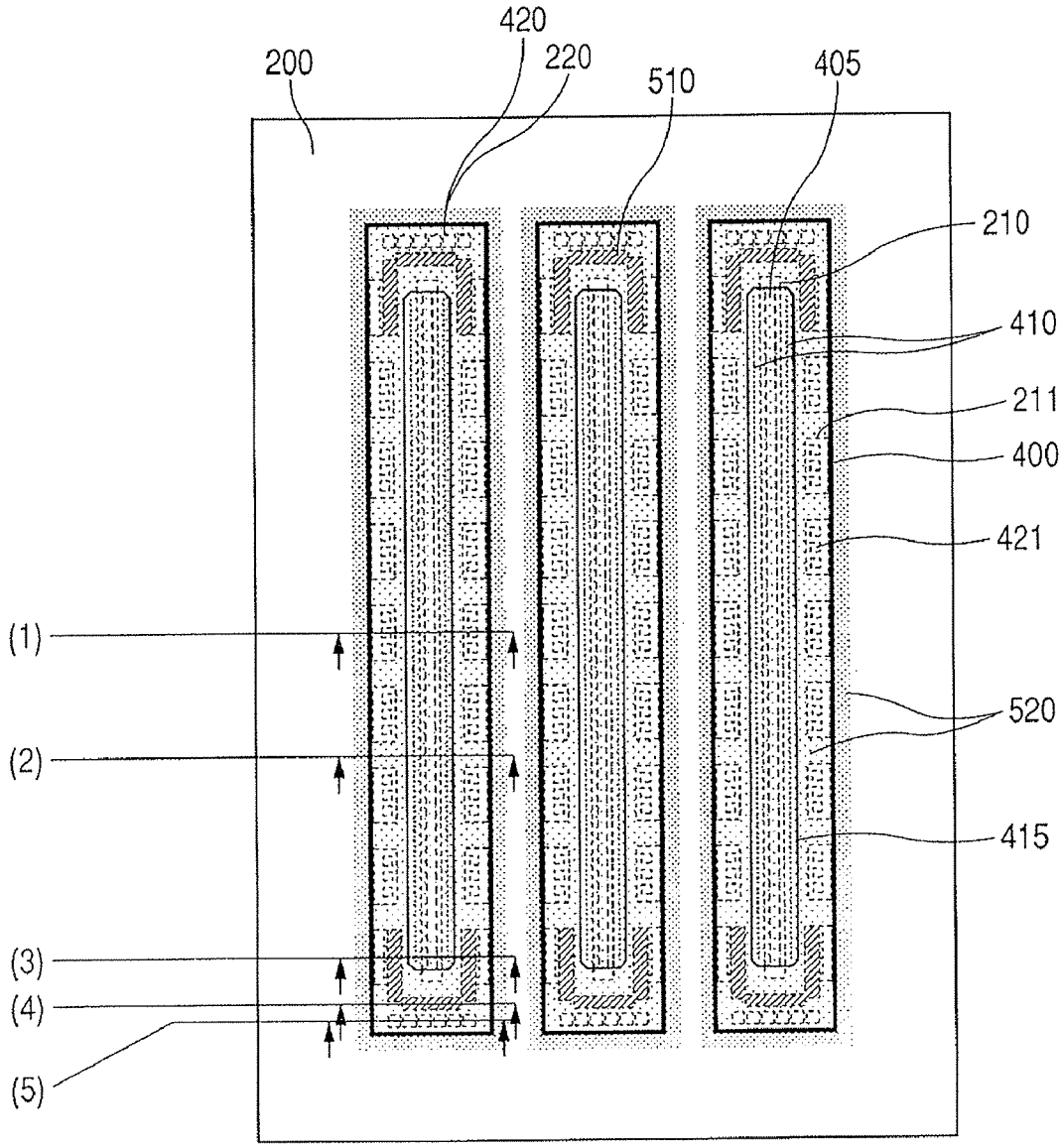
FIG. 6A shows a finished ink jet head of the present embodiment.
Figure 6B:
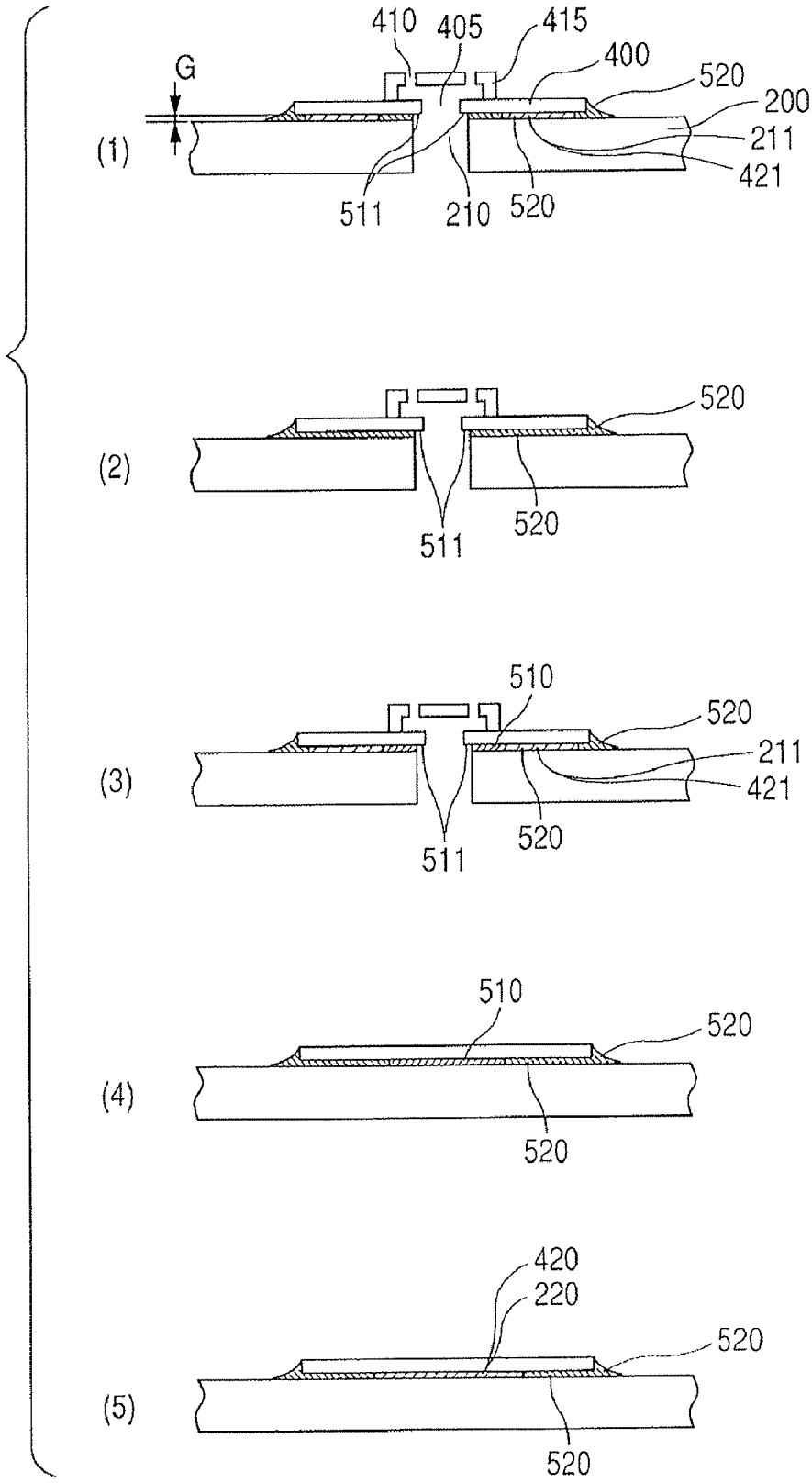
FIG. 6B is a diagrammatical cross-section view taken lines (1) to (5) shown in FIG. 6A.

FIG. 6A shows a finished ink jet head of the present embodiment. Further, FIG. 6B is a diagrammatical cross-section view taken along lines (1) to (5) shown in FIG. 6A.

The second sealing resin 520 completely got through the gap G between the recording element substrate 400 and the support member 200 due to the capillary phenomenon, and therefore, this gap G was completely hermetically sealed. In a portion except the both tip end portions in the discharge port rows of the recording element substrate 400, a meniscus film 511 of the second sealing resin 520 is formed on an edge side of the ink supply port 405 of the recording element substrate 400 and an edge side of the ink supply port 210 of the support member 200. This meniscus film 511 of the second sealing resin 520 does not cause a trouble such as blocking of an opening of the ink supply port 210 or the ink supply port 405.

Also, relating to the both tip end portions in the discharge port rows of the recording element substrate 400, the first sealing resin 510 functions as a bank, preventing the second sealing resin 520 from flowing into from the direction of the electrode (bump) 420 of the recording element substrate 400 to be excessively supplied.

Further, the second sealing resin 520 flows into a cavity portion between the inside of the U-shaped projecting portion of the first sealing resin 510 and the both tip end portions of the discharge port rows of the recording element substrate 400 (the gap G between the recording element substrate 400 and the support member 200) due to the capillary phenomenon. At this time, the second sealing resin 520 gets into from the longitudinal direction of the recording element substrate 400 and finally enters the inside of the U-shaped projecting portion of the first sealing resin 510. Here, the second sealing resin 520 forms the meniscus film 511 on the edge side of the ink supply port 210 or the ink supply port 405 and does not flow to spill at each ink supply port. Further, gas such as air remaining in the gap G between the recording element substrate 400 and the support member 200 is pushed out by the second sealing resin 520 to be exhausted through the liquid supply port 210 of the support member 200. Accordingly, an air passage, blowhole (cavity), pinhole or the like is not produced, enabling more complete sealing thereby.

Now, the embodiment described above will be described hereinafter in more detail.

The first sealing resin 510 is coated in U-shape to surround the both tip end portions of the liquid supply port 210 of the support member 200, and the recording element substrate 400 is mounted over the first sealing resin 510. This mounting of the recording element substrate 400 causes the first sealing resin 510 coated on the support member 200 to surround, in U-shape, also the both tip end portions of the discharge port rows in the recording element substrate 400. Because it is desirable to maintain the projecting shape initially formed by coating the first sealing resin 510 without change as far as possible, it is suitable to use resin having characteristics of high viscosity/high thixotropy.

The second sealing resin 520 is coated on the circumference of the side surface of the recording element substrate 400 mounted on the support member 200, and completely gets into the gap G between the recording element substrate 400 and the support member 200 due to the capillary phenomenon to cure. Accordingly, the second sealing resin 520 completely covers the electrode (bump) 420 for electrical connection and the radiation bump 421, providing complete, hermetical sealing of the gap G between the recording element substrate 400 and the support member 200. At this time, in a portion except the vicinity of the both tip end portions of the recording element substrate 400, the meniscus film 511 is formed on the edge side of the ink supply port 405 in the recording element substrate 400 and the edge side of the ink supply port 210 in the support member 200. Therefore, a trouble is not caused that the second sealing resin 520 blocks an opening of the ink supply port 210 or the ink supply port 405. Further, also in the vicinity of the both tip end portions of the recording element substrate 400, a trouble is not caused that the first sealing resin 510 or the second sealing resin 520 blocks an opening of the ink supply port 210 or the ink supply port 405. This is because the projecting shape of the first sealing resin 510 controls movement/supply of the second sealing resin in the vicinity of the both tip end portions of the recording element substrate 400 not to cause the trouble described above.

Figure 8:
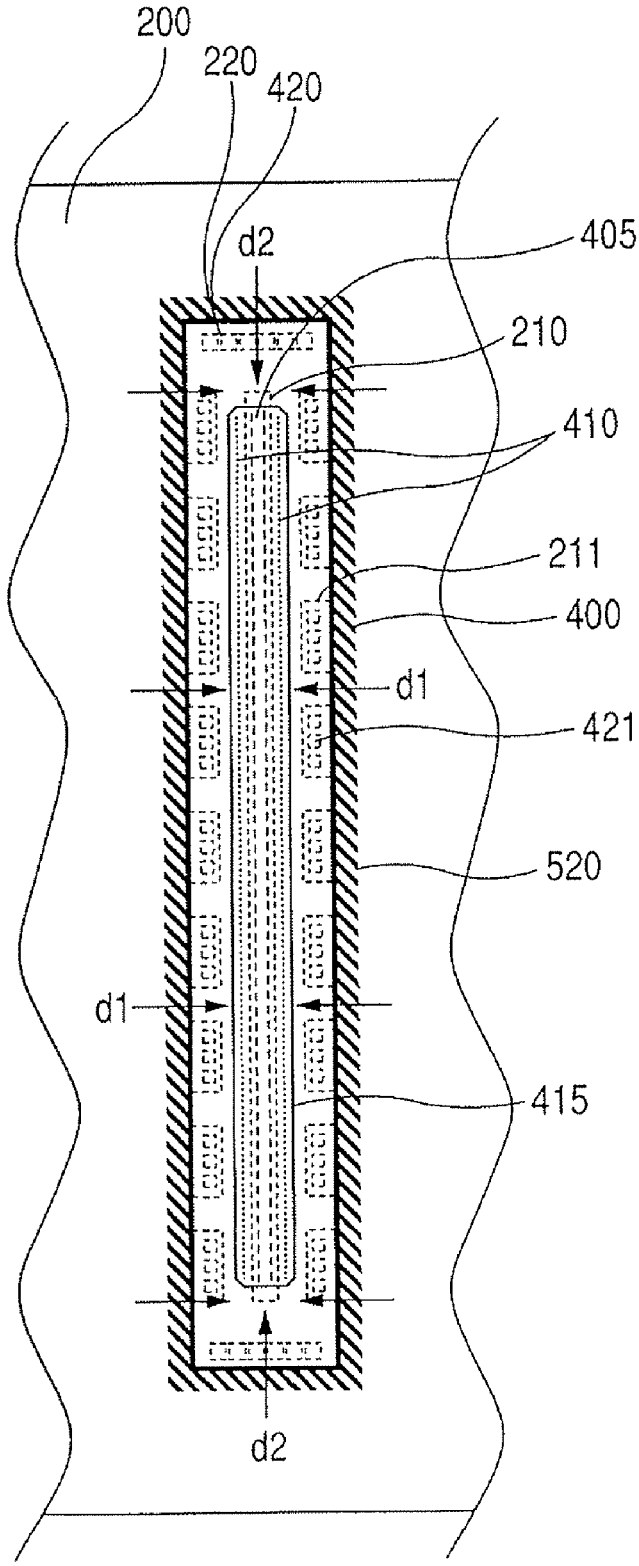
FIG. 8 is a schematic top view illustrating how the second sealing resin flows into in a process for coating the second sealing resin shown in FIGS. 5A, 5B, 6A and 6B, in the case without usage of the first sealing resin.
Figure 9:
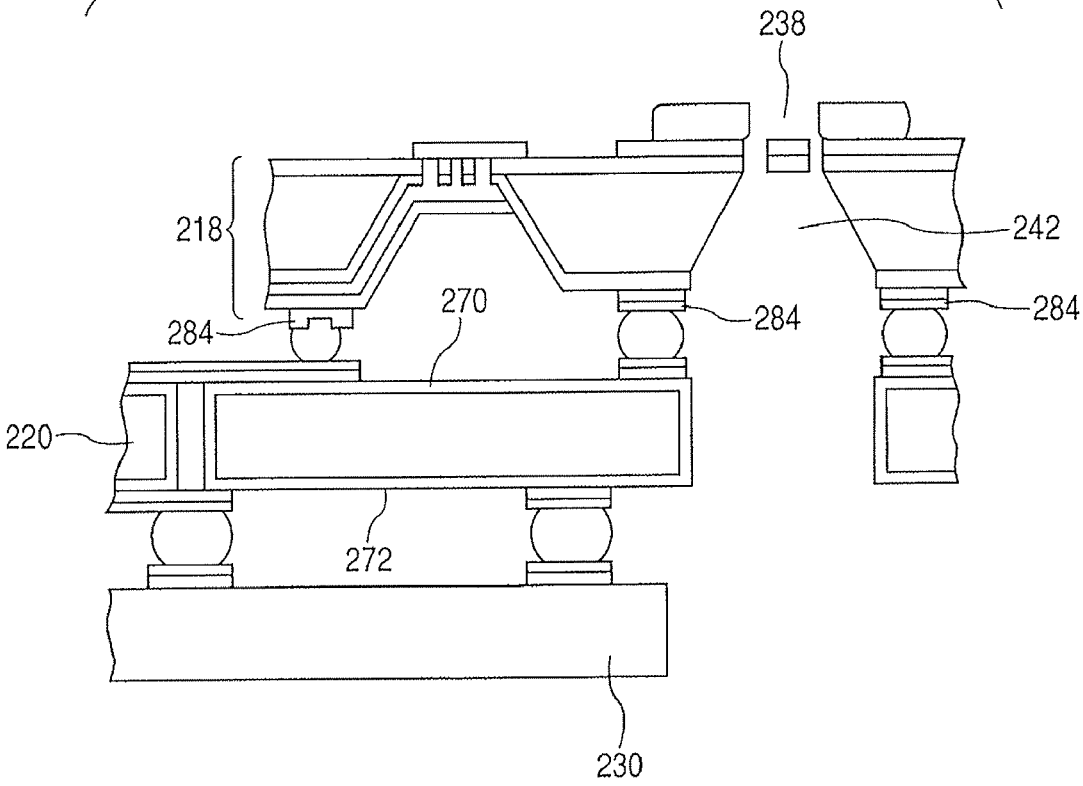
FIG. 9 is a schematic cross-section view illustrating an electrical connecting portion of a conventional ink jet head.

Now, the case without the usage of the first sealing resin 510 will be described with reference to FIG. 8.

In order that the second sealing resin 520 completely hermetically seals the gap G between the support member 200 and the recording element substrate 400 using the capillary phenomenon, it is suitable to use resin having low viscosity/low thixotropy and good fluidity. However, this may also cause a harmful effect as described below.

In the portion except the vicinity of the both tip end portions of the recording element substrate 400, the second sealing resin 520 flows into only in the d1 direction (direction intersecting with the longitudinal direction of the opening of the ink supply port 210 or the ink supply port 405). However, in the vicinity of the both tip end portions of the recording element substrate 400, the second sealing resin 520 flows into not only in the d1 direction, i.e. the direction from the right to left side or from the left to right side of FIG. 8, but also in the d2 direction, i.e. upward or downward direction in FIG. 8. The d2 direction is defined as the direction from the electrode (bump) 420 of the recording element substrate 400 or the longitudinal direction of the opening of the ink supply port 210 or the ink supply port 405, with reference to FIG. 8. Accordingly, an amount of the second sealing resin 520 supplied is more excessive than required, whereby it is made difficult to form the meniscus film 511 as described above, resulting in very difficult adjustment of an amount of the second sealing resin coated not to block the ink supply port 210 or the ink supply port 405.

Even if the amount supplied is excessive only to a slight degree, discharge failure occurs in several to several dozen ink discharge ports 410 successive from the ink discharge port 410 at the both tip end portions of the recording element substrate 400 as the starting point.

On the contrary, if the amount of the second sealing resin 520 supplied is reduced, it becomes considerably difficult to completely hermetically seal the gap G between the recording element substrate 400 including the electrode (bump) 420 and the support member 200. As a result, it is more likely to provide insufficient sealing, and the quality may drop in stability. Therefore, it is necessary to supply an extra amount, to some extent, of the second sealing resin 520.

Then, in the present embodiment, before a process for mounting the recording element substrate 400, the first sealing resin 510 is coated in the vicinity of the both tip end portions of the ink supply port 210 in the support member 200. The first sealing resin 510 coated in this way serves as a bank against the second sealing resin 520, and thereby the movement/supply of the second sealing resin 520 flowing into in the d2 direction is controlled. Therefore, the gap G between the recording element substrate 400 including the electrode (bump) 420 and the support member 200 can be completely hermetically sealed, and concurrently, discharge failure of the ink discharge port 410 in the recording element substrate 400 can be prevented.

Next, a coated shape/area of the first sealing resin 510 will be described.

In the present embodiment, a sealing process flow is divided into two processes, and first, the first sealing resin 510 is coated on the support member 200, and subsequently the recording element substrate 400 is mounted to join the electrode (bump) 420 for electrical connection and the radiation bump 421. Next, from the entire circumference of the outer peripheral part of the side surface of the recording element substrate 400, the second sealing resin 520 is coated and filled into the gap G between the support member 200 and the recording element substrate 400 (see FIG. 1). Generally, in the case of a normal semiconductor element (for example, a flip chip etc.), application of a single coating of sealing resin (underfill) completes a sealing process. On the contrary, the ink jet head of the present embodiment includes, aside from the electrode (bump) 420 for electrical connection on the back surface, the radiation bump 421, and heat generated from the recording element substrate 400 is radiated to the support member 200 through the radiation bump 421. Then, a substance except material of the radiation bump 421 and the radiation pad 211 remaining/present on a surface where the radiation bump 421 is in contact with the radiation pad 211 of the support member 200 becomes a factor which decreases heat radiation rate.

In the ink jet head of the present embodiment, assuming that the sealing process is performed once, it is required to coat the entire circumference and the peripheral part of the ink supply port 210 of the support member 200 with the first sealing resin 510, before the recording element substrate 400 is mounted on the support member 200. Alternatively, after the recording element substrate 400 is mounted on the support member 200 of the recording element substrate 400, it is required to coat the entire circumference of the outer peripheral part of the side surface of the recording element substrate 400 with the second sealing resin 520.

In the latter case, after joining the radiation bump 421 and the radiation pad 211, the second sealing resin 520 is coated, and therefore, a joint surface of the radiation bump 421 and the radiation pad 211 has no other substances therebetween, providing the best heat radiation rate. However, it is necessary to use, as the second sealing resin 520, resin having low viscosity/low thixotropy and good fluidity. Therefore, the second sealing resin 520 flows into the both tip end portions of the ink supply port 210 in the support member 200 not only in the d1 direction, i.e. from two directions, but also in the d2 direction. Then, an amount of the second sealing resin 520 supplied becomes more excessive than required, and therefore the meniscus film 511 is not formed, and as a result, discharge failure is more likely to occur in several to several dozen ink discharge ports 410 successive from the ink discharge port 410 at the both tip end portions of the recording element substrate 400 as the starting point.

On the contrary, in the former case, before mounting the recording element substrate 400 on the support member 200, the first sealing resin 510 can be coated on the peripheral part of the ink supply port 210 so as to not block it. Therefore, discharge failure of the ink discharge port 410 is less likely to occur, even when the recording element substrate 400 is mounted. Further, even if the second sealing resin 520 is coated from the outer peripheral part of the side surface of the recording element substrate 400 after mounting the recording element substrate 400, the first sealing resin 510 previously coated may serve as a bank for each of the entire circumferences of the ink supply port 210 and the ink supply port 405. Therefore, discharge failure of the ink discharge port 410 does not occur due to blocking of the ink supply port 210 or the ink supply port 405 by the second sealing resin 520.

However, in this case, the first sealing resin 510 forming the bank for each of the entire circumferences of the ink supply port 210 and the ink supply port 405 eliminates an exit hole for gas such as air present between the recording element substrate 400 and the support member 200. Accordingly, a trouble such as an air passage, blowhole, pinhole or the like may be produced thereby. Further, because for the first sealing resin 510, it is desirable to maintain the shape initially formed by coating it without change as far as possible, as described above, the resin having characteristics of high viscosity/high thixotropy is used. As a result, the first sealing resin 510 has very insufficient fluidity/emission rate. Accordingly, the first sealing resin 510 may not be completely exhausted, and it is likely to remain on the surface where the radiation bump 421 is in contact with the radiation pad 211. As a result, thermal conductivity from the recording element substrate 400 to the support member 200 is decreased, resulting in poor heat dissipation. This may increase a possibility of causing a trouble of the ink jet head due to an abnormal rise in temperature during image formation when the ink jet head is mounted on the ink jet recording apparatus.

As described above, in order to prevent discharge failure of the ink discharge port 410, it is necessary to coat the first sealing resin 510 on an appropriate portion. Also, in order to secure sufficient heat dissipation, it is important that the first sealing resin 510 be not left behind as far as possible on the joint surface between radiation bump 420 and the radiation pad 211. Then, for the reasons described above, the first sealing resin 510 is coated in the portion between the outside of the both tip end portions of the ink supply port 210 of the support member 200 and the radiation pad 211 disposed in the vicinity of the both tip end portions so as to surround each of the both tip end portions of the ink supply port 210. Coating the first sealing resin 510 in this way can control decrease in heat conductivity to the minimum. Further, discharge failure also can be prevented which is caused due to the second sealing resin 520 coated after mounting the recording element substrate 400 on the support member 200, in several to several dozen ink discharge ports 410 successive from the ink discharge port 410 corresponding to the both tip end portions of the discharge port rows as the starting point.

For forming a most efficient shape of the first sealing resin 510, it is suitable to form a continuous bank against the second sealing resin 520 flowing into in the d1 direction (two directions) and the d2 direction by the first sealing resin 510 correspondingly to each of the directions.

In the present embodiment, the coated shape of the first sealing resin 510 is a projecting "U-shape", and this allows for formation of a continuous bank in an unbroken line in the perpendicular directions to the d1 and d2 directions, respectively. Then, also, the U-shape substantially includes, for example, a C-shape, V-shape or the like which may be expected to have the effect as described above.

Further, the first sealing resin 510 is crushed due to mounting of the recording element substrate 400 to be slightly widened (extended), and so the first sealing resin 510 is not coated continuously in three sides according to the U-shape, and then it can be coated in three short straight lines (alternatively, several dots thereof are coated on a particular portion) in the perpendicular directions to the d1 and d2 directions, respectively, to form each bank, providing the same advantageous result.

In addition, the present embodiment as described above includes the electrothermal conversion element for generating heat energy to discharge ink, and, needless to say, the present invention is also applicable to a liquid discharge head in which the ink is discharged by other methods, such as using a vibrating element.

As described above, the ink jet head manufactured by mounting the recording element substrate 400 on the support member 200 is joined to a plastic housing having a contact portion for electrical connection with the ink jet recording apparatus, and a part for mounting an ink tank. The head cartridge, in this way, is finished (see FIG. 7).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-148146, filed May 29, 2006, which is hereby incorporated by reference herein in its entirety.

What is claimed is:

1. A method for manufacturing a liquid discharge head comprising on a front surface thereof, a plurality of discharge ports for discharging liquid and an energy generating unit for generating energy for discharging liquid, on a back surface thereof, a plurality of electrodes, and a support member including a liquid discharge substrate having a through-hole for feeding liquid from a back surface to a front surface, a support surface for supporting the liquid discharge substrate thereon, a pad disposed on the support surface and connected to the plurality of electrodes, and a rectangular liquid supply port for supplying liquid to the through-hole on the liquid discharge substrate, wherein the method comprises:

coating a first sealing resin on a portion between the liquid supply port and the pad on the support surface so as to surround a tip end portion at the liquid supply port of the support member when a mounting portion of the liquid discharge substrate and the support member is hermetically sealed;

mounting the liquid discharge substrate on the support member to join one of the plurality of electrodes to the pad; and filling a gap between the support member and the liquid discharge substrate with a second sealing resin from a circumference of the liquid discharge substrate on the support member.

2. The method according to claim 1, wherein the first sealing resin hermetically seals the gap between the liquid discharge substrate and the support member, and concurrently maintains a shape which does not block the through-hole and the liquid supply port, after the liquid discharge substrate is mounted on the support member.

3. The method according to claim 1, wherein the second sealing resin flows within the gap between the support member and the liquid discharge substrate due to the capillary phenomenon, after the liquid discharge substrate is mounted on the support member.

4. The method according to claim 3, wherein the second sealing resin forms a meniscus film on an edge side of the through-hole or the liquid supply port.

5. The method according to claim 3, wherein the second sealing resin flows into a portion between the tip end portion of the liquid supply port and the first sealing resin due to the capillary phenomenon.

6. The method according to claim 1, wherein the shape in which the first sealing resin surrounds the tip end portion of the liquid supply port of the support member is a projecting shape having one side in the direction intersecting with the longitudinal direction of the liquid supply port and two sides in the longitudinal direction thereof.

7. The method according to claim 1, wherein a radiation bump is provided on a back surface of the recording element substrate, a radiation pad is provided on the support surface of the support member, and after the liquid discharge substrate is mounted on the support member, the radiation bump is in contact with the radiation pad.

8. A liquid discharge head, comprising on a front surface thereof, a plurality of discharge ports for discharging liquid and an energy generating unit for generating energy for discharging liquid, on a back surface thereof, a plurality of electrodes, and a support member including a liquid discharge substrate having a through-hole for feeding liquid from a back surface to a front surface, a support surface for supporting the liquid discharge substrate thereon, a pad disposed on the support surface and connected to the plurality of electrodes, and a rectangular liquid supply port for supplying liquid to the through-hole on the liquid discharge substrate, and for joining one of the plurality of electrodes and the pad to mount the liquid discharge substrate on the support member, wherein the liquid discharge head comprises:

a first sealing resin coated on a portion between the liquid supply port and the pad on the support surface so as to surround a tip end portion at the liquid supply port of the support member; and a second sealing resin for hermetically sealing a gap between the support member and the liquid discharge substrate, and a peripheral portion of the liquid supply port.

9. The liquid discharge head according to claim 8, wherein a radiation bump is provided on a back surface of the recording element substrate, a radiation pad is provided on the support surface of the support member, and the radiation bump is in contact with the radiation pad.

10. The liquid discharge head according to claim 8, wherein a shape in which the first sealing resin surrounds the tip end portion of the liquid supply port of the support member is a projecting shape having one side in the direction intersecting with the longitudinal direction of the liquid supply port and two sides in the longitudinal direction thereof.

* * * * *